US005325015A

United States Patent [19]

Yamamoto

[11] Patent Number: 5,325,015

[45] Date of Patent: Jun. 28, 1994

[54] VACUUM FLUORESCENT DISPLAY TUBE HAVING A BUILT IN DRIVING SEMICONDUCTOR ELEMENT THEREIN

[75] Inventor: Jiro Yamamoto, Tokyo, Japan

[73] Assignee: NEC Corporation, Japan

[21] Appl. No.: 788,343

[22] Filed: Nov. 6, 1991

[30] Foreign Application Priority Data

Nov. 7, 1990 [JP] Japan ..... 2-302239

[51] Int. Cl.[5] ..... H01J 31/15

[52] U.S. Cl. ..... 313/484; 313/483; 313/495; 313/497

[58] Field of Search ..... 313/483, 484, 494, 495, 313/496, 497

[56] References Cited

U.S. PATENT DOCUMENTS 4,661,743 4/1987 Matsuoka et al. ..... 313/446
4,835,445 5/1989 Watanabe et al. ..... 313/497

FOREIGN PATENT DOCUMENTS 0105939 8/1980 Japan ..... 313/495
4163839 6/1992 Japan ..... 313/483

*Primary Examiner*—Donald J. Yusko
*Assistant Examiner*—Nimesh Patel
*Attorney, Agent, or Firm*—Laff, Whitesel, Conte & Saret

[57] ABSTRACT

A fluorescent display tube has a filament support integrally formed of a metal sheet with a shield for protecting a driving semiconductor element accommodated in the vacuum container. Shield connections for joining the filament support and the shield are in the form of a plurality of fine wires formed from the same metal sheet and extend from two opposing sides of the shield. Each shield connection is fitted into a sealing area between the cover glass and the anode substrate. These shield connections are designed so as to improve heat dissipation at the time of the getter flashing following vacuum-sealing of the fluorescent display tube.

7 Claims, 3 Drawing Sheets

VACUUM FLUORESCENT DISPLAY TUBE HAVING A BUILT IN DRIVING SEMICONDUCTOR ELEMENT THEREIN

BACKGROUND OF THE INVENTION

1. Field of the Invention

The present invention relates to a fluorescent display tube and more particularly to a fluorescent display tube having a built-in driving semiconductor element in a vacuum container.

2. Description of the Related Art

Fluorescent display tubes of the sort described above have been known to include a metal shield to prevent a driving semiconductor element from being damaged at the time of getter flashing which is formed integrally with a filament support.

More specifically, as shown in FIG. 1(*a*), a shield 1 has outward extending eaves 3 of the minimum size necessary to cover a driving semiconductor element 2 and a wire bonding area. The shield connections 5 for joining the filament support 4 to the shield 1 are in the form of a plurality of fine wires extending from opposing sides of the shield 1 to each lead 6. Each shield connection 5 has a width ranging from about half the thickness to about the same thickness of the metal sheet blank from which the metal shield is formed. The shield connections 5 comprise a plurality of fine wires which are subjected to plastic deformation to provide the solid form shown in FIG. 1(*b*). The solid form is composed of fixing parts 7 for supporting filaments, a getter fitting part 8, the shield 1, the shield connections 5 and the outward extending eaves 3. Any other part which is not a solid body in the shield support structure is made flat so as to reinforce the structure of the filament support 4. Before the fluorescent tube is vacuum sealed, a part of the filament support 4 in combination with the lead 6 is fitted into the sealing area 9 between the cover glass and the anode substrate which form the vacuum container. In this way, a fluorescent display tube is produced.

The fluorescent display tube needs a getter film to improve and maintain the degree of the enclosed vacuum. As the getter film is impenetrable to light, the common practice has been to form the getter film not within the domain of the display portion (not shown) but on the side of the filament support 4 having the shield 1 so as not to affect the visual display.

As set forth above, the getter film essential for improving and maintaining the degree of the vacuum inside the fluorescent display tube is formed by locally heating the getter by induction heating to evaporate and deposit the getter material inside the tube. However, since each shield connection 5 located close to the getter fitting part 8 forms a closed circuit as shown in FIGS. 1(*a*) and 1(*b*), there is a possibility that the shield connections 5 will be heated by the high-frequency induction current which flows at the time the getter is locally heated by high-frequency induction heating.

Although the filament support 4 is held between the cover glass and the anode substrate for sealing purposes, both the filament support 4 and the shield connections 5 tend to float off the anode substrate (not shown) because, with the exception of the sealing area 9, there exists a small gap with the anode substrate. Consequently, the heat dissipation property of the shield connection 5 in the conventional shield support structure is poor when it is heated by high-frequency induction heating, and the shield connection 5 may ultimately fuse with the rise in temperature. This has been the reason for the low production yield of the fluorescent display tubes.

SUMMARY OF THE INVENTION

An object of the present invention is to provide a fluorescent display tube whose shield connections are free from fusion at the time of getter flashing and which enables a high production yield.

In a fluorescent display tube having the built-in driving semiconductor element in the vacuum container according to the present invention, the filament support and the shield for covering the semiconductor element are formed integrally from a metal sheet, and shield connections for joining the filament support and the shield are in the form of a plurality of fine wires extending outwardly from both sides of the shield toward their respective leads in the filament support 4. Each shield connection has a width ranging from the same to five times the thickness of the metal sheet. The shield connections are vacuum-sealed in a position conforming approximately to the sealing area between the cover glass and the anode substrate constituting the vacuum container.

In a variation of the present invention, the shield connections for joining the filament support and the shield are in the form of a plurality of strip-like fine wires.

In another variation of the present invention, each shield connection is a fine wire in an oval race-track-like form composed of two semicircular portions connected to two straight-line portions. The two straight-line portions are used to connect the shield connection to the filament support and the shield.

With the shield connections according to the present invention as described above, fusion of the shield connections is prevented because the heat generated in the shield connections at the time of getter flashing is diffused to the vacuum container, which is composed of the cover glass and the anode substrate, via the frit seal.

The above and other objects, features and advantages of the present invention will become apparent from the following description with reference to the accompanying drawings which illustrate preferred embodiments of the present invention.

BRIEF DESCRIPTION OF THE DRAWINGS

FIG. 1(*b*) is a perspective view of the conventional shield support structure of FIG. 1(*a*) to give a three-dimensional representation of the structure.

DETAILED DESCRIPTION OF THE PREFERRED EMBODIMENTS

Figure 1A:
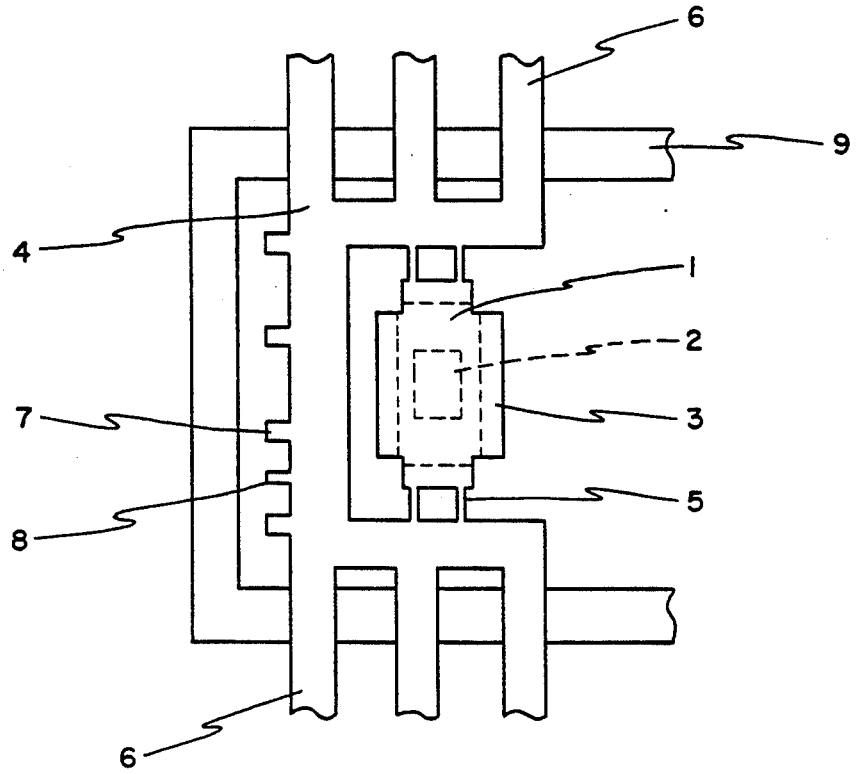
FIG. 1a (PRIOR ART)
FIG. 1(*a*) is a top view of a shield support structure in a conventional fluorescent display tube.
Figure 1B:
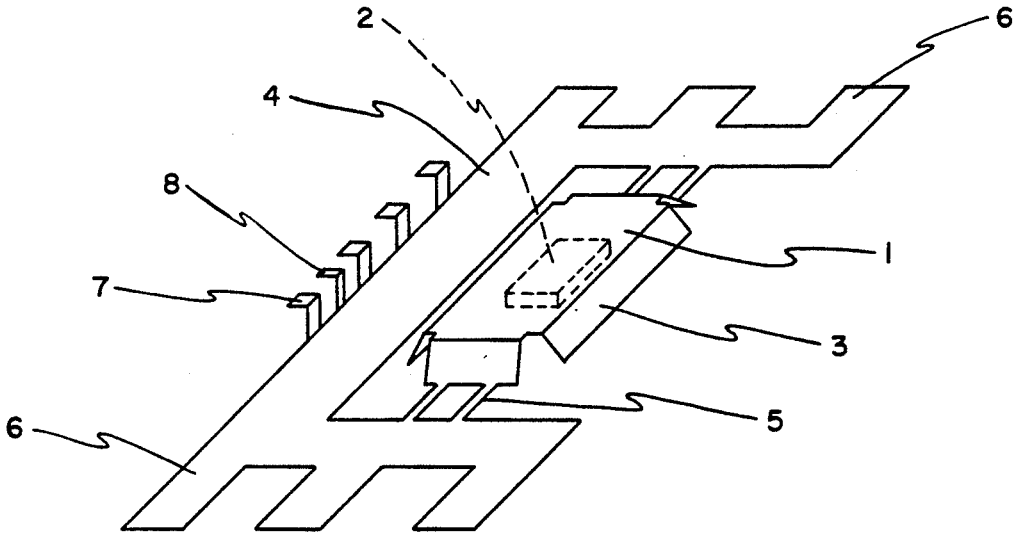
FIG. 1b (PRIOR ART)
Figure 2:
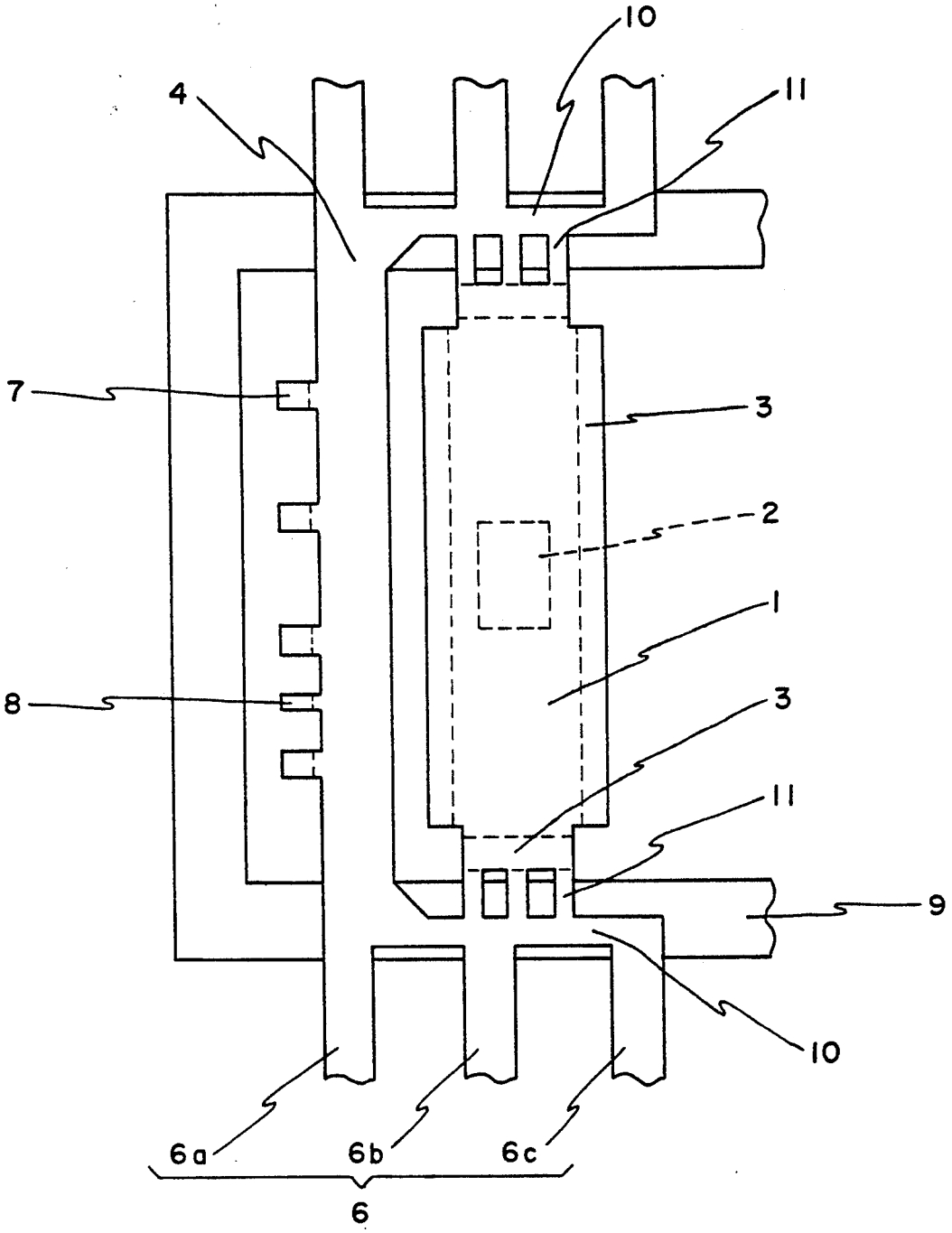
FIG. 2 is a top view of a shield support structure of a preferred embodiment of the present invention.

In the embodiment shown in FIG. 2, the shield 1 is larger than the combination of the driving semiconductor element 2 and the wire bonding area (not shown) around the element, and two opposing sides of the shield 1 extend close to the sealing area 9 in which the outgoing leads 6 are located. The coupling part 10 for coupling outgoing leads 6*b*, 6*c* to an outgoing lead 6*a* is formed so as to lead directly out from the filament support 4 but to stay in the sealing area 9 for the cover glass and anode substrate (both not shown). A shield connection 11 is provided between the eaves 3 at the leading ends of the shield 1 and the coupling part 10. Three strip-like shield connections 11, each 1.0 mm wide and 2.0 mm long, are formed on each of two opposing sides of the shield 1 in such a way that about $\frac{2}{3}$ of their length remains within the sealing area 9.

The filament support 4, the outgoing leads 6*a*, 6*b*, 6*c*, the shield 1, the shield connections 11 and the coupling parts 10 are all formed from a sheet blank 0.2 mm thick and composed of an alloy whose components are, for example, 42% Ni, 6% Cr, and 52% Fe (hereinafter called "426 alloy sheet"). These components are formed into the predetermined shape by the processes of photoetching and solid-forming. The shield connections 11 are then slightly extended to correct the dimensional distortion resulting from the solid-forming process.

The resulting positional relations are such that most of the shield connections 11 stays within the sealing area 9 and the portion extending out of the sealing area 9 is sufficiently covered by the frit seal.

As a result, even when getter flashing is carried out after the fluorescent display tube is vacuum-sealed and the remaining air extracted, the heat generated by high-frequency induction heating in the shield connections 11 is diffused to the vacuum container composed of the cover glass and the anode substrate via the frit seal, thereby preventing the temperature of each shield connection from rising high enough to fuse the connection.

Figure 3:
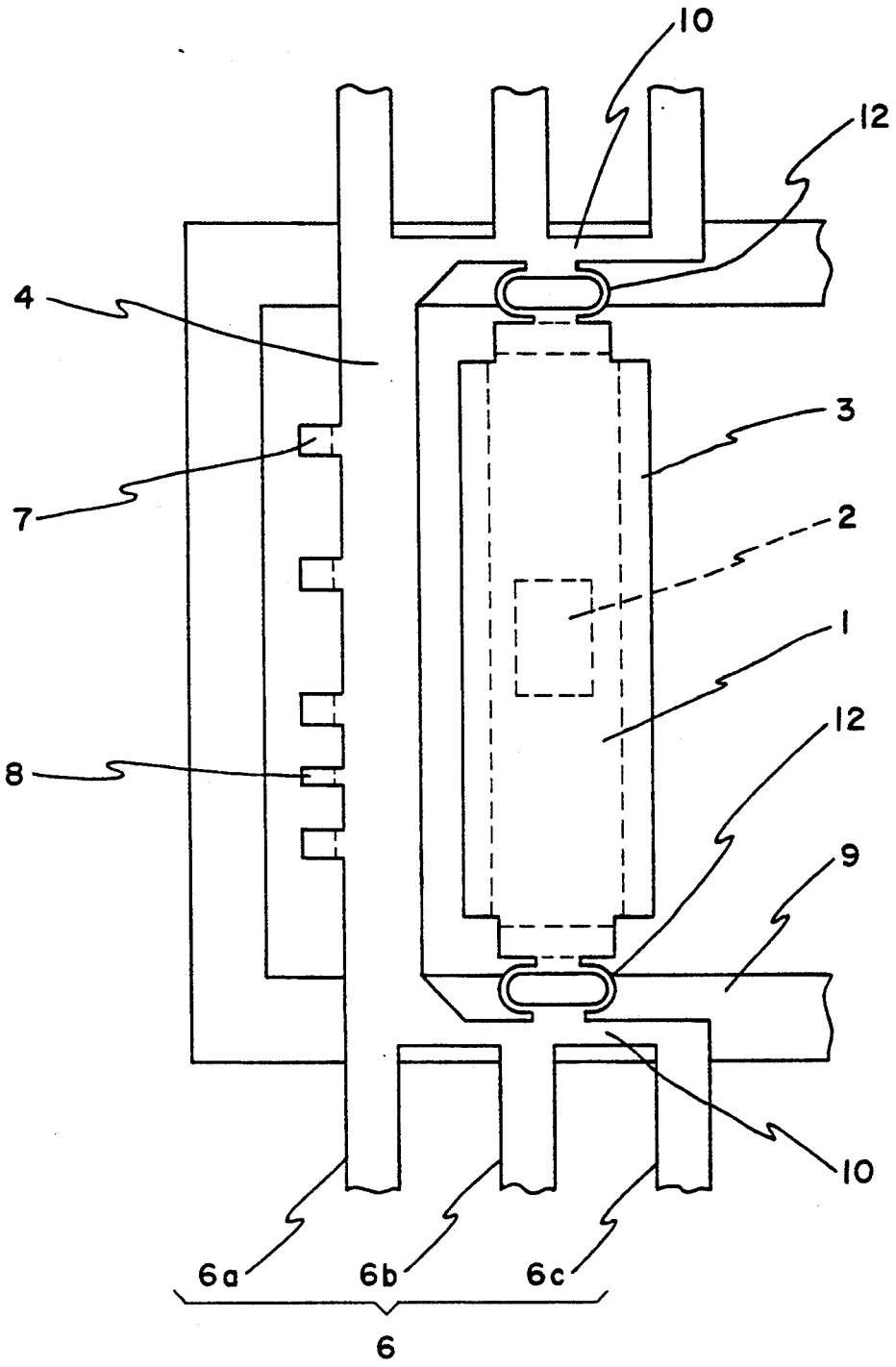
FIG. 3 is a top view of another shield support structure in a fluorescent display tube according to the present invention.

In another embodiment shown in FIG. 3, all components other than shield connections 12 are similar in construction to those shown in the embodiment of FIG. 2.

The shield connections 12 according to this embodiment are provided on both sides of the shield 1 and each shield connection consists of two semicircle strips 0.5 mm wide with the radius of the semicircle drawn to the middle of the strip being 0.5 mm, and two straight-line strips 0.5 mm wide and 1.0 mm long. These four strips are formed in the shape of a racetrack on each side of the shield 1 in such a manner that about $\frac{3}{4}$ of the area enclosed by the oval stays within the sealing area 9.

As in the preceding embodiment, the filament support 4, the outgoing leads 6, the shield 1, the shield connections 12 and the coupling part 10 are prepared from 426 alloy sheet 0.2 mm thick. These components are formed into the predetermined shape by the processes of photoetching and solid-forming. The shield connections 12 are then slightly extended to correct the dimensional distortion resulting during the solid-forming process.

The resulting positional relations are such that most of the shield connection 12 stays within the sealing area 9, and the portion extending out of the sealing area 9 is sufficiently covered by the frit seal.

As a result, when getter flashing is carried out following vacuum sealing and air extraction from the fluorescent display tube, the heat generated by high-frequency induction heating in the shield connections 12 is diffused to the vacuum container, which is composed of the cover glass and anode substrate, via the frit seal. In this way, the temperature of each shield connections is prevented from rising to a point high enough to fuse the connection.

Although certain preferred embodiments of the present invention have been shown and described in detail, it should be understood that various changes and modifications may be made without departing from the scope of the appended claims.

I claim:

1. A fluorescent display tube having a built-in driving semiconductor element in a vacuum container, said display tube comprising a filament support and a shield for covering said semiconductor element which are integrally formed from a metal sheet blank, the shield connections for joining said filament support and said shield, said shield connections being in the form of a plurality of fine wires extending from two opposing sides of said shield toward respective outgoing leads, each of said shield connections having a width ranging from a thickness of said metal sheet blank to five times the thickness of said metal sheet blank so as to be slightly extended to correct a dimensional distortion, and said shield connections being vacuum-sealed by a frit seal in a position approximately to a sealing area between a cover glass and an anode substrate constituting said vacuum container such that most of said shield connections stay within said sealing area and portions of said shield connections extending out of said sealing area are sufficiently covered by said frit seal.

2. A fluorescent display tube as claimed in claim 1, characterized in that said shield connections are in the form of a plurality of strip-like fine wires.

3. A fluorescent display tube as claimed in claim 1, characterized in that each shield connection is a fine wire in an oval racetrack-like form formed from two semi-circular portions connected to two straight-line portions, wherein the two straight-line portions are used to connect said shield connection to said filament support and said shield.

4. A vacuum fluorescent display tube having a built-in driving semiconductor element in a vacuum container, said display tube comprising: a shield portion for covering said semiconductor element within said vacuum container, a filament support portion integrally connected to said shield portion and being located within said vacuum container, a coupling portion for coupling said filament support portion and a plurality of outgoing leads, said outgoing leads being led out from said vacuum container through a sealing area thereof, and a shield connection member made of a plurality of strip-shaped fine wires and being provided between an edge of said shield portion and said coupling portion, most of said shield connection member being located within said sealing area of said vacuum container and a portion thereof extending out of said sealing area and being sufficiently covered by a frit seal provided at said sealing area for preventing a temperature of said shield connection member from rising high enough to fuse said fine wires.

5. A vacuum fluorescent display tube as claimed in claim 4, wherein each of said fine wires has a width ranging from a thickness of said shield portion to five times the thickness of said shield portion.

6. A vacuum fluorescent display tube as claimed in claim 4, wherein said shield connection member is slightly extended to correct a dimensional distortion resulting from a solid-forming process for said shield portion.

7. A vacuum fluorescent display tube having a built-in driving semiconductor element in a vacuum container, said display tube comprising:

a shield portion for covering said semiconductor element within said vacuum container, a filament support portion integrally connected to said shield portion and being located within said vacuum container, a coupling portion for coupling said filament support portion and a plurality of outgoing leads, said outgoing leads being led out from said vacuum container through a sealing area thereof, and a shield connection member made of a fine wire formed into an oval racetrack form, said oval being formed from two semi-circular portions connected to two straight-line portions, most of said shield connection member being located within said sealing area of said vacuum container and a portion of said shield connected member extending out of said sealing area and being partially covered by a frit seal at said sealing area, said sealing area being sufficient to prevent a temperature of said shield connection member from rising high enough to fuse said fine wire.

* * * * *